US007800550B2

(12) United States Patent
Hsieh et al.

(10) Patent No.: US 7,800,550 B2
(45) Date of Patent: Sep. 21, 2010

(54) DIPOLE ANTENNA ARRAY

(75) Inventors: Lee-Ting Hsieh, Yanpu Township, Pingtung County (TW); Chih-Hao Lai, Guansi Township, Hsinchu County (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 394 days.

(21) Appl. No.: 12/071,843

(22) Filed: Feb. 27, 2008

(65) Prior Publication Data

US 2009/0213024 A1 Aug. 27, 2009

(51) Int. Cl.
*H01Q 9/28* (2006.01)

(52) U.S. Cl. ..... 343/795; 343/810

(58) Field of Classification Search ..... 343/795, 343/810, 846, 700 MS
See application file for complete search history.

(56) References Cited

U.S. PATENT DOCUMENTS 6,747,605 B2 * 6/2004 Lebaric et al. ..... 343/795
6,859,176 B2 * 2/2005 Choi ..... 343/700 MS
7,277,062 B1 * 10/2007 Loyet ..... 343/795

* cited by examiner

*Primary Examiner*—Hoang V Nguyen
(74) *Attorney, Agent, or Firm*—Rosenberg, Klein & Lee

(57) ABSTRACT

A dipole antenna array includes a dielectric substrate; electric tuning elements mounted on a first surface and a second surface of the dielectric substrate; resonance elements and ground elements; and a feed line. Each resonance element includes first resonance parts, second resonance parts and a third resonance part. One of the second resonance parts connects the corresponding first resonance part to the third resonance part. The other second resonance parts respectively connect two neighboring first resonance parts. Each ground element includes first ground parts, second ground parts and a third ground part. One of the second ground parts connects one of the first ground parts to the third ground part. The other second ground parts respectively connect to two neighboring first ground parts.

9 Claims, 6 Drawing Sheets

DIPOLE ANTENNA ARRAY

BACKGROUND OF THE INVENTION

1. Field of the Invention

The invention generally relates to a dipole antenna, and particularly to a dipole antenna array.

2. Description of the Related Art

Commercially available antennas installed inside electronic products can be operated with a single operational frequency. However, the single operational frequency has not satisfied the requirement of increasingly powerful products and not caught up with the trend of versatile design with compact volume, either.

Therefore, there is a need of a dipole antenna which has multiple operational frequencies and compact volume.

SUMMARY OF THE INVENTION

It is an object of the invention to provide a dipole antenna array which offers multiple operational frequencies and has a compact volume.

It is another object of the invention to provide a method of adjusting a dipole antenna array which can tune the operational frequency to a predetermined value.

In order to achieve the above and other objectives, the dipole antenna array includes a dielectric substrate, a plurality of first electric tuning elements, and a feed line.

The dielectric substrate has a first surface and a second surface opposite to the first surface; a plurality of resonance elements, a plurality of ground elements, The first electric tuning elements, are mounted on the first surface and the second surface of the dielectric substrate.

The resonance elements are mounted on the first surface of the dielectric substrate. Each resonance element includes a first resonance part, a second resonance part and a third resonance part. The second resonance part connects the first resonance part to the third resonance part. A first slot is formed on each of opposite sides of the second resonance part. A second slot is formed between one end of the third resonance part away from the second resonance part and one end of the electric tuning element close to the third resonance part. A third slot is formed on the end of the third resonance part away from the second resonance part.

The ground elements are mounted on the second surface of the dielectric substrate. Each ground element includes a first ground part, a second ground part and a third ground part. The second ground part connects the first ground part to the third ground part. Another first slot is formed at each of the opposite sides of the second ground part. Another second slot is formed between one end of the third ground part away from the second ground part and one end of one electric tuning element close to the third ground part. A third slot is further formed on the end of the third ground part away from the second ground part.

The feed line is electrically connecting to at least one resonance element and at least ground resonance elements.

Furthermore, a dipole antenna array of the invention includes a dielectric substrate having a first surface and a second surface opposite to the first surface; a plurality of electric tuning elements mounted on the first surface and the second surface of the dielectric substrate; a plurality of resonance elements mounted on the first surface of the dielectric substrate; a plurality of ground elements mounted on the second surface of the dielectric substrate; and a feed line electrically connecting to at least one resonance element and at least ground resonance elements Each resonance element including a plurality of first resonance parts, a plurality of second resonance parts and a third resonance part. One of the second resonance parts connects the corresponding first resonance part to the third resonance part. The other second resonance parts respectively connect two neighboring first resonance parts. A first slot is formed at each of opposite sides of at least one of the second resonance parts. A second slot is formed between one end of the third resonance part away from the respective second resonance part and one end of at least one of the electric tuning elements close to the third resonance part. A third slot is formed on the end of the third resonance part away from the respective second resonance part.

Each ground element includes a plurality of first ground parts, a plurality of second ground parts and a third ground part. One of the second ground parts connects one of the first ground parts to the third ground part. The other second ground parts respectively connect to two neighboring first ground parts. Another first slot is formed at each of the opposite sides of the second ground parts. Another second slot is formed between one end of the third ground part away from the respective second ground part and one end of at least one of the electric tuning elements close to the third ground part. A third slot further is formed on the end of the third ground part away from the respective second ground part.

The resonance element and the ground element are formed on the same plane of the substrate. This configuration makes the dipole antenna of the invention thin and compact, saving the space of the dipole antenna inside the electric products. The dipole antenna also has multiple operational frequencies.

To provide a further understanding of the invention, the following detailed description illustrates embodiments and examples of the invention, this detailed description being provided only for illustration of the invention.

DETAILED DESCRIPTION OF THE EMBODIMENTS

Figure 1A:
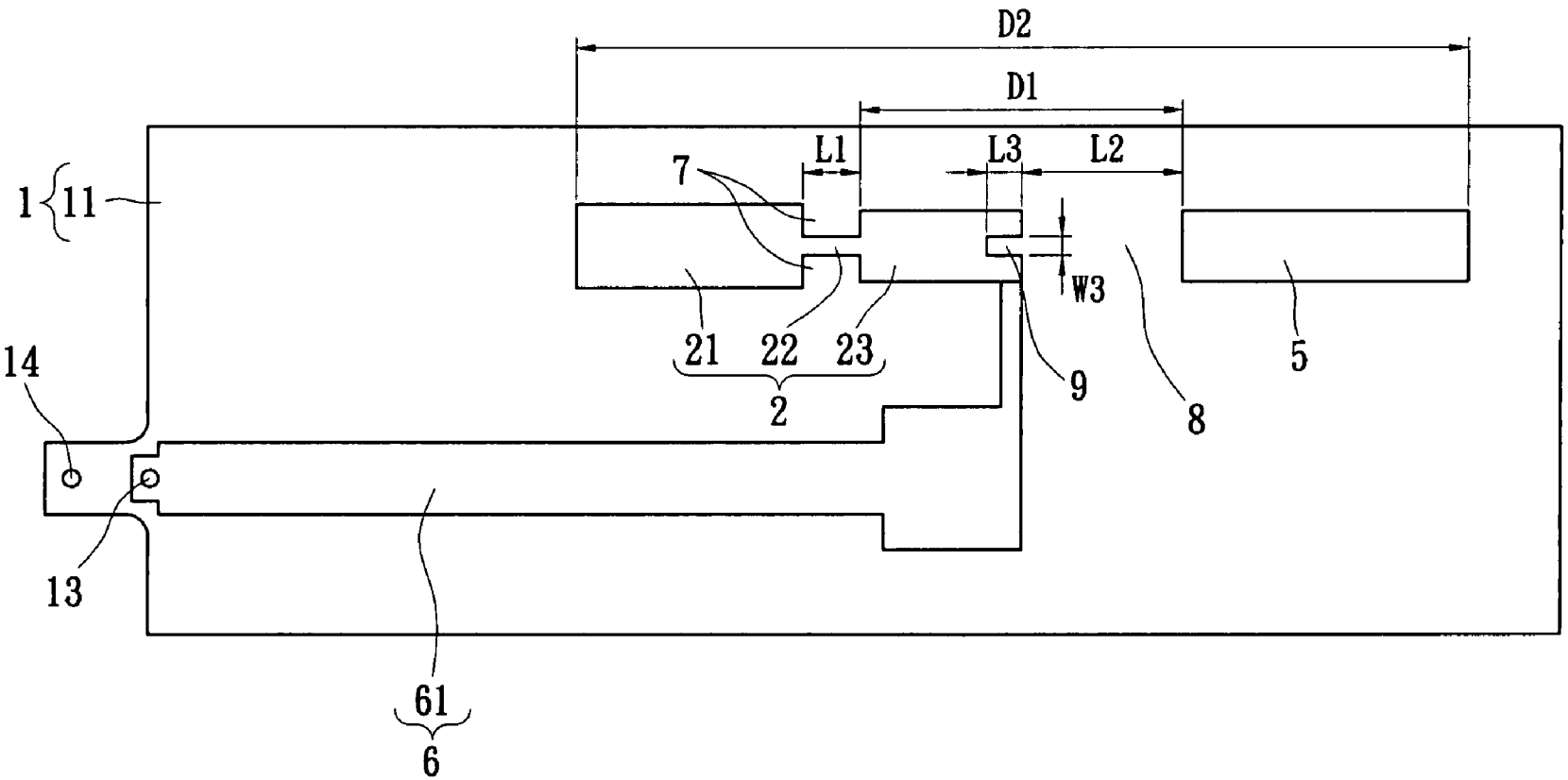
FIG. 1A is a schematic plan view of a dipole antenna on a first surface according to one embodiment of the invention.

Wherever possible in the following description, like reference numerals will refer to like elements and parts unless otherwise illustrated.

Figure 1B:
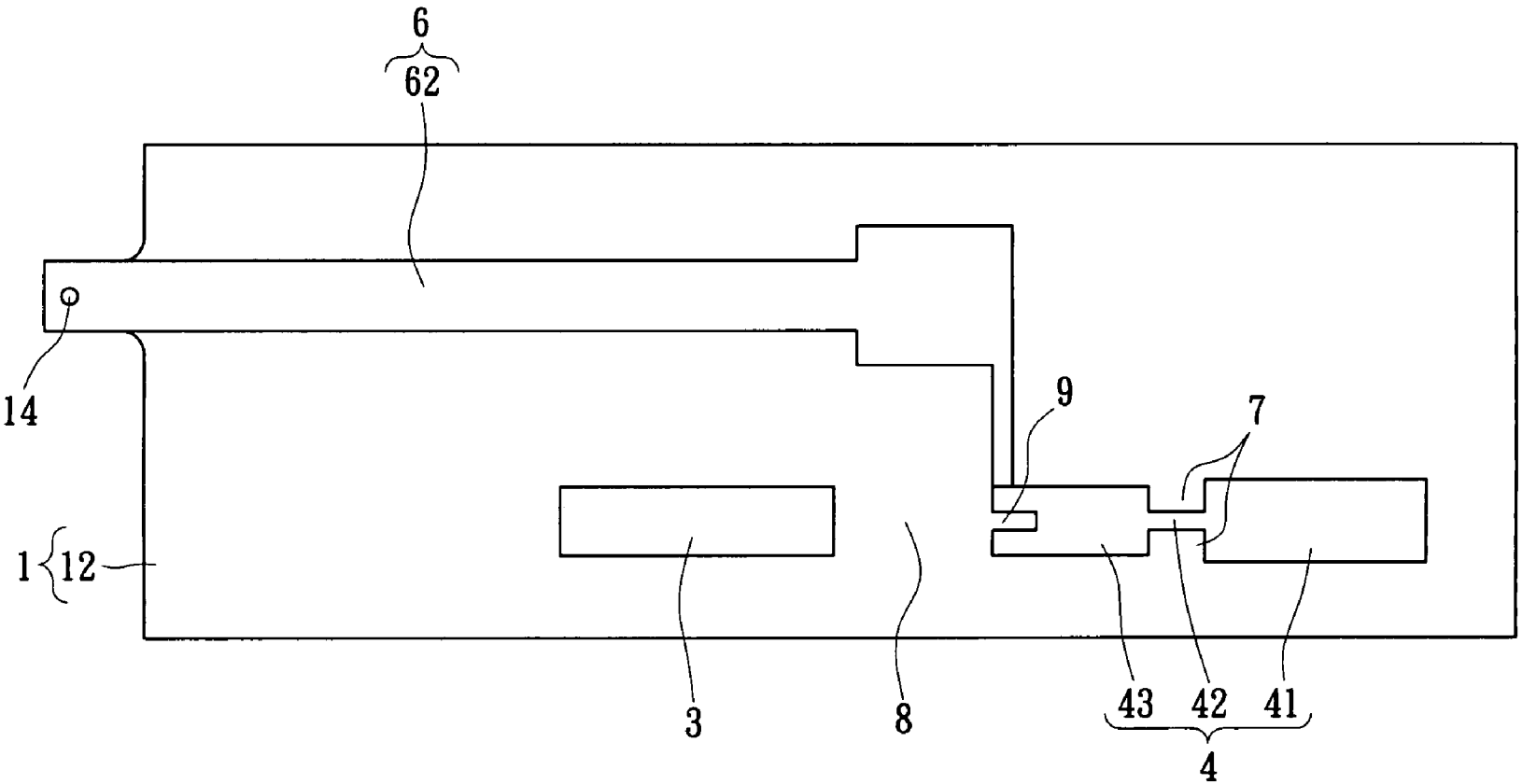
FIG. 1B is a schematic plan view of a dipole antenna on a second surface according to one embodiment of the invention.
Figure 2:
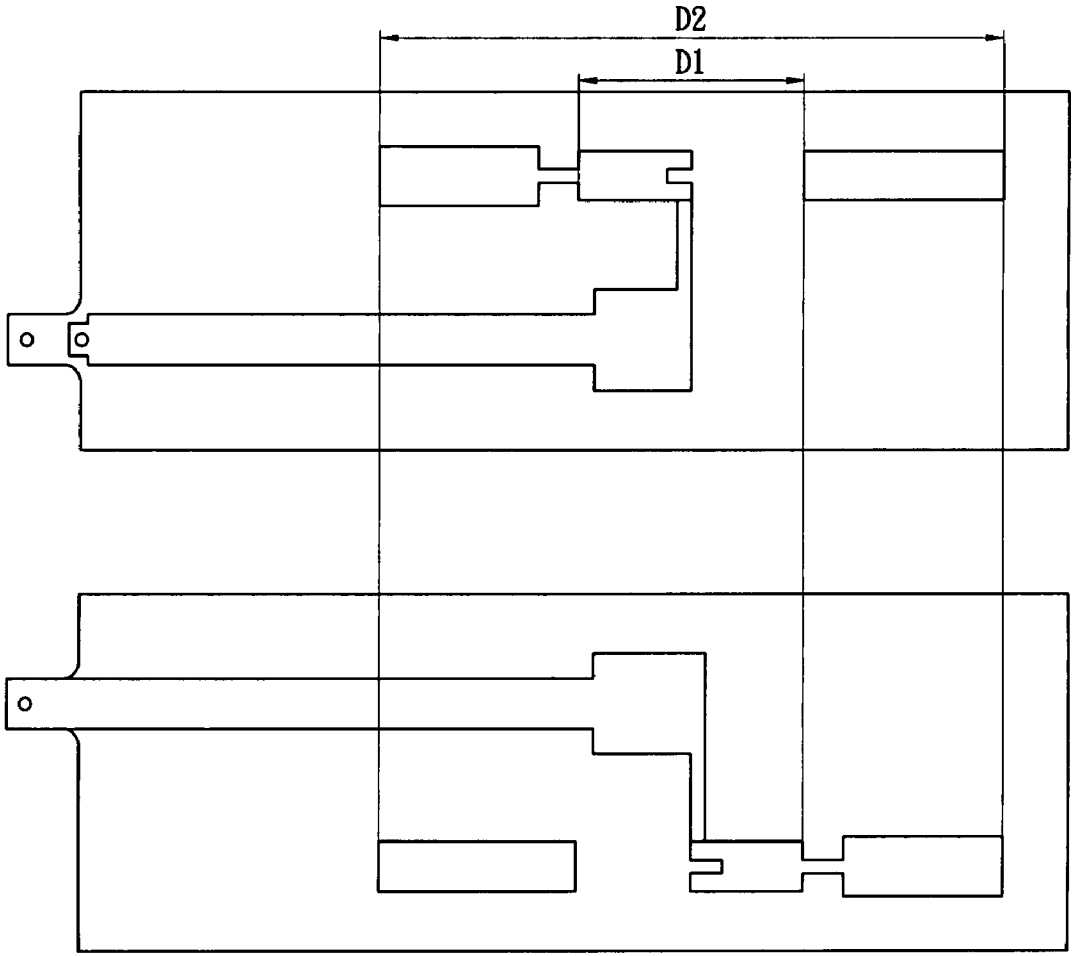
FIG. 2 shows a relative between the resonance element on the first surface and the ground element on the second surface of the dipole antenna according to one embodiment of the invention.

As shown in FIG. 1A, FIG. 1B and FIG. 2, a dipole antenna includes a, dielectric substrate 1, a resonance element 2, a first electric tuning element 3, a ground element 4, a second electric tuning element 5, and a feed line 6. The dielectric substrate 1 is, for example, a printed circuit board made of resin or glass fiber enhanced epoxy resin, or a flexible thin substrate made of polyimide. The dielectric substrate 1 has a first surface 11 and a second surface 12. The first surface 11 has a feed point 13. The first surface 11 and the second surface 12 respectively have a ground point 14. The first electric tuning element 3 and the second electric tuning element 5 respectively have a thickness matching a thickness of the dielectric substrate 1 in a manner to affect a capacitance generated by the dipole antenna.

The resonance element 2, the first electric tuning element 3, the ground element 4 and the second electric tuning element 5 are made of metal. The resonance element 2 is formed on the first surface 11 of the dielectric substrate 11 by etching or printing. The first electric tuning element 3 is formed on the second surface 12 by etching or printing. The second electric tuning element 5 is formed on the first surface 11 by etching or printing. The ground element 4 is formed on the second surface 12 by etching or printing.

The resonance element 2 includes a first resonance part 21, a second resonance part 22 and a third resonance part 23. The second resonance part 22 connects the first resonance part 21 to the third resonance part 23. A first slot 7 is formed on each of opposite sides of the second resonance part 22. Between one end of the third resonance part 23 away from the second resonance part 22 and one end of the second electric tuning element 5 close to the third resonance part 23 is formed a second slot 8. A slot 9 is formed on the end of the third resonance part 23 away from the second resonance part 22.

The ground element 4 includes a first ground part 41, a second ground part 42 and a third ground part 43. Between the first ground part 41 and the third ground part 43 are formed two of the first slots 7. One end of the opposite sides of the second ground part 42 is formed a first slot 7. A second slot 8 is formed between one end of the third ground 43 away from the second ground part 42 and one end of the first electric tuning element 3 close to the third ground part 4. A third slot 9 is formed on the end of the third ground part 43 away from the second ground part 42.

The feed line 6 includes a signal transmission line 61 and a ground line 62. The signal transmission line 61 and the ground line 62 have different diameters, and therefore different impedances. The signal transmission line 61 and the ground line 62 are respectively disposed on the first surface 11 and the second surface 12 of the dielectric substrate 1. The signal transmission line 61, the resonance element 2 and the feed point 13 are electrically connected to one another. The ground line 12, the ground element 4 and the ground point 14 are electrically connected to one another.

Figure 3:
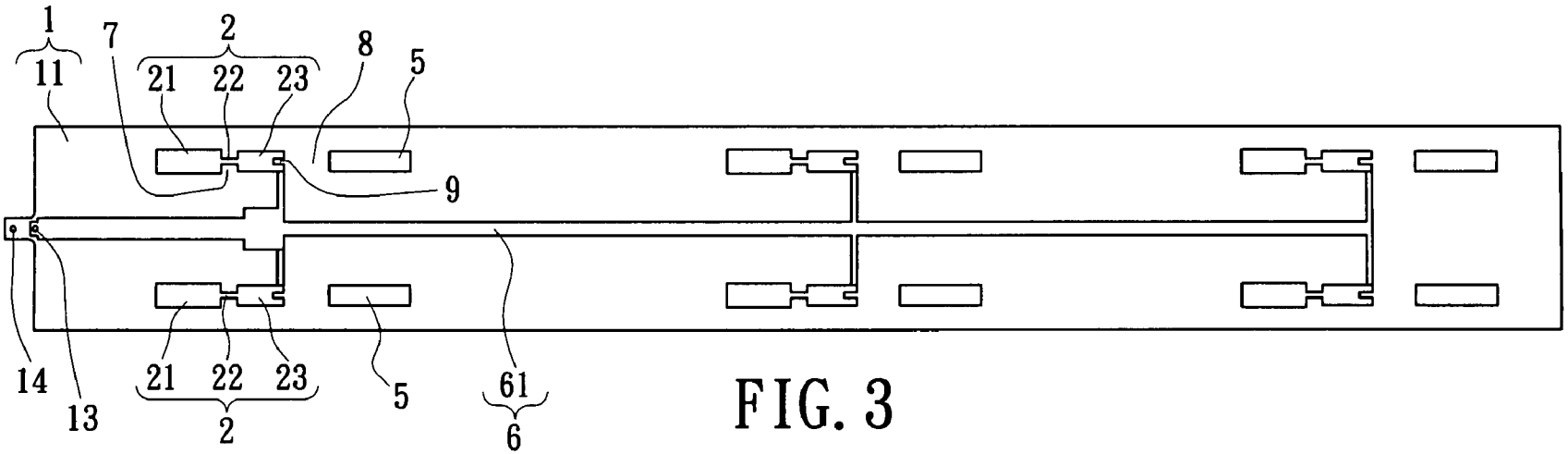
FIG. 3 is a schematic plan view of a dipole antenna array on a first surface according to one embodiment of the invention.
Figure 4:
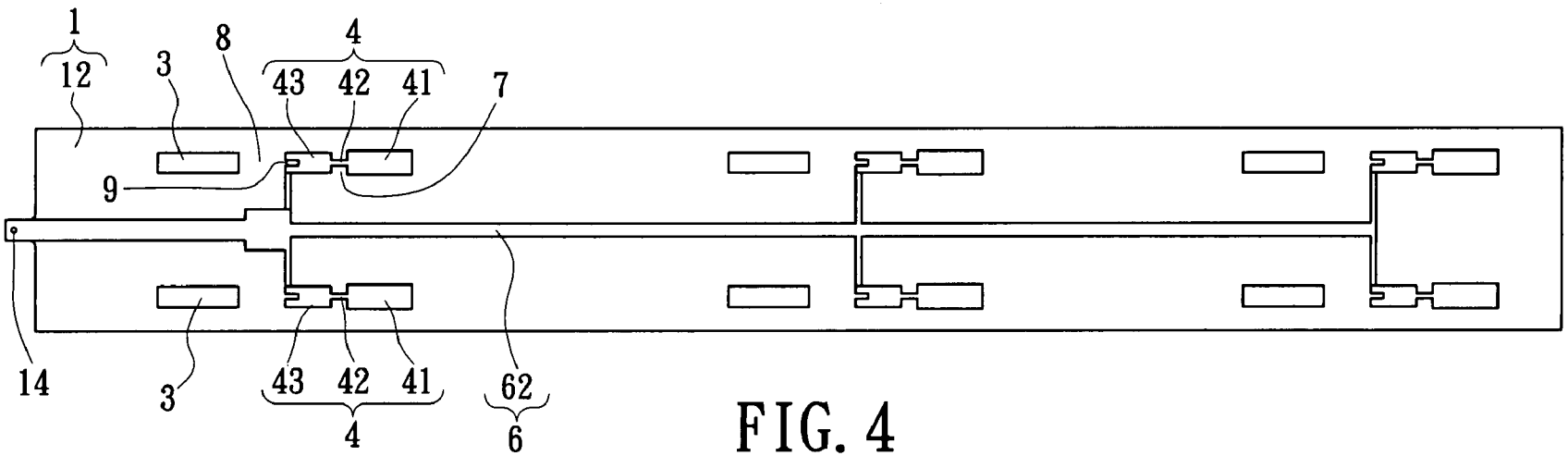
FIG. 4 is a schematic plan view of a dipole antenna array on a second surface according to one embodiment of the invention.

FIG. 3 and FIG. 4 show a dipole antenna array according to one embodiment of the invention. As shown in figures above, the dielectric substrate 1 has a plurality of resonance elements 2, a plurality of first electric tuning elements 3, a plurality of ground elements 4, and a plurality of second electric tuning elements 5. The resonance elements 2 are arranged in pair and each pair of the resonance elements 2 are connected to one feed line 6 along the lengthwise direction of the feed line 6. The ground elements 4 are arranged in pair and each pair of the resonance elements are connected to another feed line 6 along the lengthwise direction of the feed line 6. Therefore, an array consisting of the resonance elements 2 and the ground elements 4 is formed. The more the number of the resonance elements 2 and the ground elements 4 are connected, the higher the gain value of the antenna is. As the gain value is higher, the signal energy is stronger and the longer distance the signal can be transmitted. However, the gain value should be limited beyond a statutory limit for the healthy safety concern.

Figure 5:
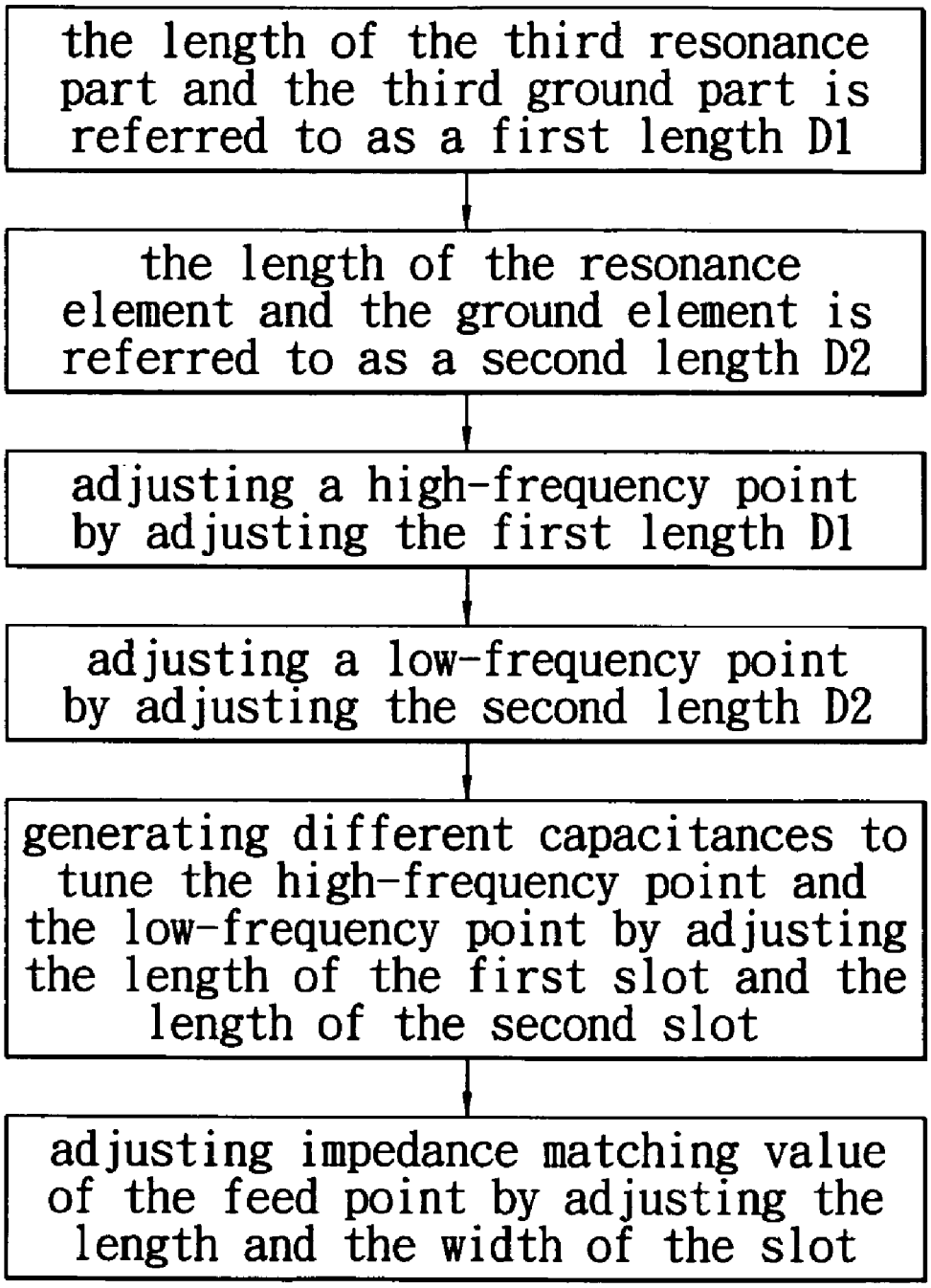
FIG. 5 is a flow chart of adjusting a dipole antenna array according to one embodiment of the invention.

FIG. 2 and FIG. 5 show a method of adjusting a dipole antenna array according to one embodiment of the invention. In this embodiment, the sum of the length of the third resonance part 23 and the length of the third ground part 43 is referred to as a first length D1, and sum of the length of the resonance element 2 and the length of the ground element 4 is referred to as a second length D2. The method includes steps of adjusting a high-frequency point by adjusting the first length D1; adjusting a low-frequency point by adjusting the second length D2; generating different capacitances to tune the high-frequency point and the low-frequency point by adjusting the length L1 of the first slot 7 and the length L2 of the second slot 8; and adjusting impedance matching value of the feed point 13 by adjusting the length L3 and the width W3 of the slot 9.

Figure 6:
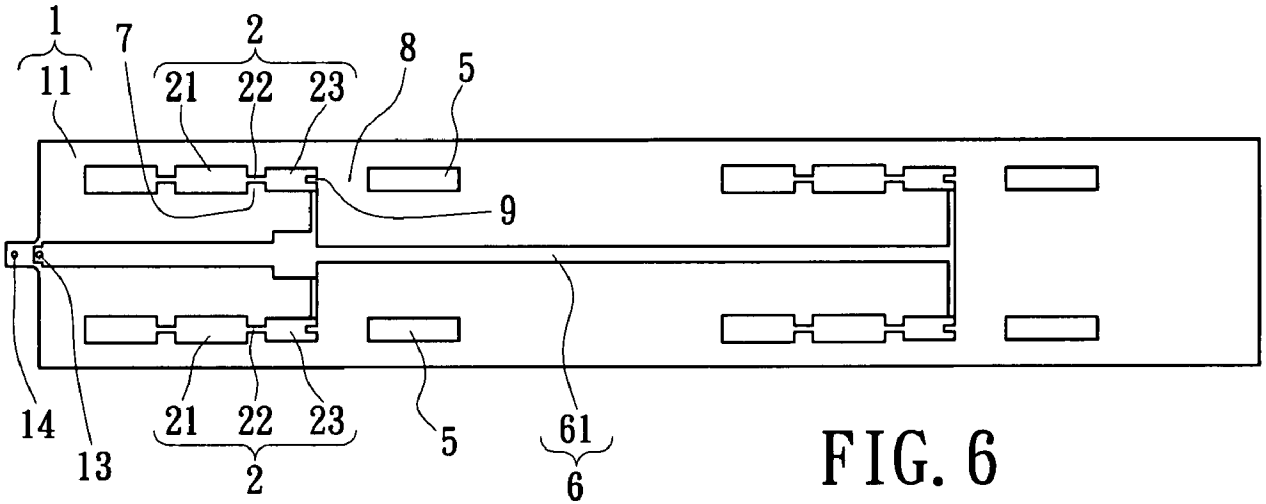
FIG. 6 is a schematic plan view of a dipole antenna array on a first surface according to another embodiment of the invention.
Figure 7:
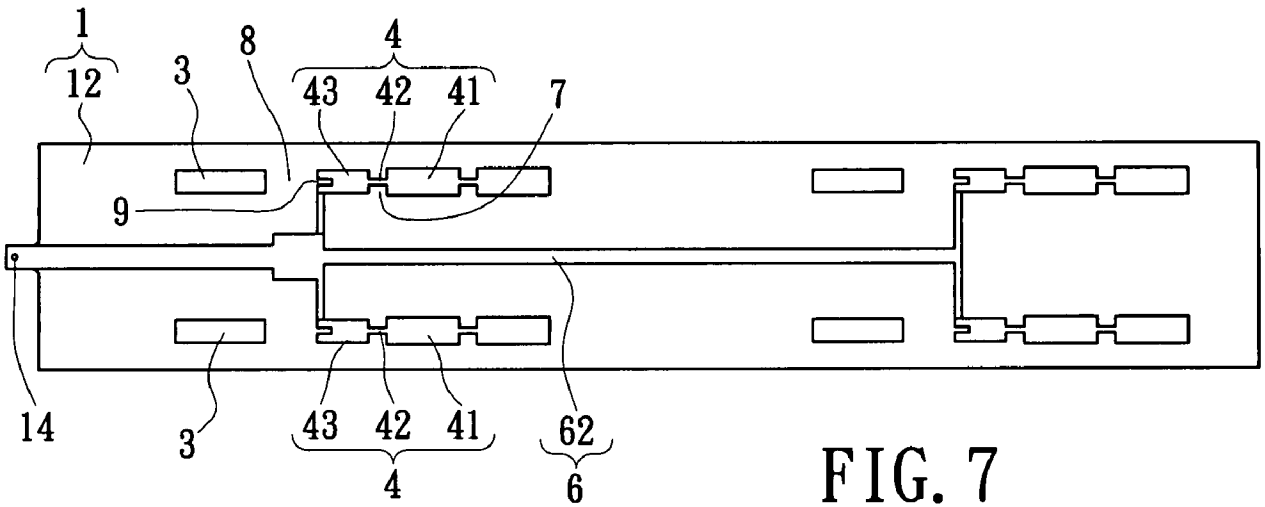
FIG. 7 is a schematic plan view of a dipole antenna array on a second surface according to another embodiment of the invention.

FIG. 6 and FIG. 7 show a dipole antenna array according to another embodiment of the invention. The dielectric substrate 1 has a plurality of resonance elements 2, a plurality of electric tuning elements 3, a plurality of ground elements 4 and a plurality of electric tuning elements 5. The number of operational frequencies of the dipole antenna array of the invention can be increased by one by means of adding one more first resonance part 21 and a first ground part 41. In this embodiment, the number of operational frequencies is 3, for example. One of the second resonance parts 22 connects the corresponding first resonance part 21 to the third resonance part 23. The other second resonance parts 22 are respectively located between two neighboring first resonance parts 21. One of the second ground parts 42 connects the corresponding first ground part 41 to the third ground part 43. The other second is ground parts 42 are respectively located between the neighboring first ground parts 41.

In the dipole antenna array of the invention, the resonance elements 2 and the ground elements 4 are formed on the dielectric substrate 1 to make the whole dipole antenna array thin and compact. Furthermore, the dipole antenna array has multiple operational frequencies.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A dipole antenna array, comprising:

a dielectric substrate, having a first surface and a second surface opposite to the first surface;

a plurality of first electric tuning elements, mounted on the first surface and the second surface of the dielectric substrate;

a plurality of resonance elements, mounted on the first surface of the dielectric substrate, each resonance element including a first resonance part, a second resonance part and a third resonance part, the second resonance part connecting the first resonance part to the third resonance part, a first slot being formed on each of opposite sides of the second resonance part, a second slot being formed between one end of the third resonance part away from the second resonance part and one end of the electric tuning element close to the third resonance part, a third slot being formed on the end of the third resonance part away from the second resonance part;

a plurality of ground elements, mounted on the second surface of the dielectric substrate, each ground element including a first ground part, a second ground part and a third ground part, the second ground part connecting the first ground part to the third ground part, another first slot being formed at each of the opposite sides of the second ground part, another second slot being formed between one end of the third ground part away from the second ground part and one end of one electric tuning element close to the third ground part, a third slot further being formed on the end of the third ground part away from the second ground part; and a feed line, electrically connecting to at least one resonance element and at least ground resonance elements.

2. The dipole antenna array of claim 1, wherein the dielectric substrate is a printed circuit board made of resin or glass fiber enhanced epoxy resin.

3. The dipole antenna array of claim 1, wherein the dielectric substrate is a flexible thin substrate made of polyimide.

4. The dipole antenna array of claim 1, wherein the resonance element, the first electric tuning element, the ground element and the second electric tuning element are made of metal, and formed on the dielectric substrate.

5. The dipole antenna array of claim 1, wherein the resonance element, the first electric tuning element, the ground element and the second electric tuning element are made of metal, and formed on the dielectric substrate.

6. The dipole antenna array of claim 1, wherein the feed line includes a signal transmission line and a ground line, the signal transmission line and the ground line being respectively disposed on the first surface and the second surface of the dielectric substrate, the signal transmission line being electrically connected to the resonance element, and the ground line being electrically connected to the ground element.

7. The dipole antenna array of claim 6, wherein the signal transmission line and the ground line have different diameters.

8. The dipole antenna array of claim 6, wherein the first surface has a feed point, the first surface and the second surface respectively having a ground point, the feed point being electrically connected to the signal transmission line, and the ground point being electrically connected to the ground line.

9. A dipole antenna array, comprising:

a dielectric substrate, having a first surface and a second surface opposite to the first surface;

a plurality of electric tuning elements, mounted on the first surface and the second surface of the dielectric substrate;

a plurality of resonance elements, mounted on the first surface of the dielectric substrate, each resonance element including a plurality of first resonance parts, a plurality of second resonance parts and a third resonance part, one of the second resonance parts connecting the corresponding first resonance part to the third resonance part, the other second resonance parts connecting two neighboring first resonance parts, a first slot being formed at each of opposite sides of at least one of the second resonance parts, a second slot being formed between one end of the third resonance part away from the respective second resonance part and one end of at least one of the electric tuning elements close to the third resonance part, a third slot being formed on the end of the third resonance part away from the respective second resonance part;

a plurality of ground elements, mounted on the second surface of the dielectric substrate, each ground element including a plurality of first ground parts, a plurality of second ground parts and a third ground part, one of the second ground parts connecting one of the first ground parts to the third ground part, the other second ground parts respectively connecting to two neighboring first ground parts, another first slot being formed at each of the opposite sides of the second ground parts, another second slot being formed between one end of the third ground part away from the respective second ground part and one end of at least one of the electric tuning elements close to the third ground part, a third slot further being formed on the end of the third ground part away from the respective second ground part; and a feed line, electrically connecting to at least one resonance element and at least ground resonance elements.

* * * * *